US007462042B2

(12) United States Patent
Chawgo

(10) Patent No.: US 7,462,042 B2
(45) Date of Patent: Dec. 9, 2008

(54) BONDING BLOCK FOR COAXIAL CABLE

(75) Inventor: Shawn Chawgo, Liverpool, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/133,051

(22) Filed: May 19, 2005

(65) Prior Publication Data

US 2008/0160827 A1 Jul. 3, 2008

(51) Int. Cl.
*H01R 13/648* (2006.01)

(52) U.S. Cl. ..... 439/97; 439/92

(58) Field of Classification Search ..... 439/92–108
See application file for complete search history.

(56) References Cited

U.S. PATENT DOCUMENTS 3,694,794 A * 9/1972 Hein ..... 439/431
4,461,521 A * 7/1984 Sachs ..... 439/95
4,917,615 A * 4/1990 Franks, Jr. ..... 439/98
5,114,354 A * 5/1992 Franks, Jr. ..... 439/92
5,203,716 A * 4/1993 Martucci et al. ..... 439/411
5,370,345 A * 12/1994 Condon ..... 248/65
5,777,263 A * 7/1998 Maehler et al. ..... 174/51
6,252,166 B1 * 6/2001 Leschinger ..... 439/92
6,431,885 B1 * 8/2002 Stroup ..... 439/94
D486,791 S * 2/2004 Franks, Jr. ..... D13/133
D487,427 S * 3/2004 Franks, Jr. ..... D13/133
6,752,640 B2 * 6/2004 Chen ..... 439/92
6,877,996 B1 * 4/2005 Franks, Jr. ..... 439/92

* cited by examiner

*Primary Examiner*—Briggitte R Hammond
(74) *Attorney, Agent, or Firm*—Pastel Law Firm; Christopher R. Pastel

(57) ABSTRACT

A bonding block includes a first flat portion, a second flat portion orthogonal to and connected to the first flat portion, and a third flat portion orthogonal to and connected to the first flat portion. The third flat portion is substantially parallel to the second flat portion. A cable connector body is press-fitted into a hole in the first flat portion, staked to the flat portion, and covered by a dress ring. A ground connecting portion for retaining a ground wire is in the form of a box, with the bottom of the box including a retaining groove and the top of the box including a seizure screw. The front and rear of the box contain holes to permit alternate entry locations for the ground wire. The bonding block is preferably formed from a single piece of stainless steel.

6 Claims, 2 Drawing Sheets

BONDING BLOCK FOR COAXIAL CABLE

FIELD OF THE INVENTION

This invention relates generally to the field of coaxial cables and their use, and more particularly to a bonding block used to provide a ground for a coaxial cable.

BACKGROUND OF THE INVENTION

In a CATV (Cable TV) system, the outer conductor of the coaxial cable is electrically bonded to earth ground, i.e., grounded, at every end-user's home. This grounding is typically accomplished using a device called a bonding block or ground block. This device is usually located outside the home near the electrical service entry. Bonding is achieved by attaching the coaxial cable to the bonding block and attaching a wire from the electrical service ground to the bonding block. Because residential bonding blocks are usually outside the home, they are exposed to the elements such as rain, salt, sunlight, temperature extremes, and other harsh conditions. Since bonding blocks are primarily used as safety devices, it is imperative that they maintain a quality bond between the outer conductor of the coaxial cable and earth ground under these conditions.

Most existing ground blocks are made of inferior materials such as aluminum or zinc and corrode very quickly. Some are made of stainless steel but are constructed in such a way as to allow moisture to penetrate the interface between the coaxial cable and the bonding block, thus degrading the television signal and causing corrosion at the interface unless a weather seal is used.

SUMMARY OF THE INVENTION

Briefly stated, a bonding block includes a first flat portion, a second flat portion orthogonal to and connected to the first flat portion, and a third flat portion orthogonal to and connected to the first flat portion. The third flat portion is substantially parallel to the second flat portion. A cable connector body is press-fitted into a hole in the first flat portion, staked to the flat portion, and covered by a dress ring. A ground connecting portion for retaining a ground wire is in the form of a box, with the bottom of the box including a retaining groove and the top of the box including a seizure screw. The front and rear of the box contain holes to permit alternate entry locations for the ground wire. The bonding block is preferably formed from a single piece of stainless steel.

According to an embodiment of the invention, a bonding block includes a first flat portion; a second flat portion orthogonal to and connected to the first flat portion; a third flat portion orthogonal to and connected to the first flat portion, and substantially parallel to the second flat portion; the first flat portion including a hole therein; a cable connector body press-fitted into the hole, staked to the flat portion, and covered by a dress ring; and a ground connecting portion for retaining a ground wire.

According to an embodiment of the invention, a bonding block includes a first flat portion; a second flat portion orthogonal to and connected to the first flat portion; a third flat portion orthogonal to and connected to the first flat portion, and substantially parallel to the second flat portion; a cable connector body connected to the first flat portion; a connecting portion connected to the second flat portion, wherein the connecting portion includes a folded metal frame; the folded metal frame creating a box with a top side, a bottom side opposite the top side, a front side, and a rear side opposite the front side, with a right side being formed from edges of the top side, the bottom side, the front side, and the rear side, and with a left side opposite the right side being formed from edges of the top side, the bottom side, the front side, and the rear side; a seizure screw in the top side; and a plurality of openings in the front side, the rear side, the right side, and the left side, wherein each of the plurality of openings permits a ground wire to be retained within the folded metal frame by the seizure screw.

According to an embodiment of the invention, a method of manufacturing a bonding block includes the steps of (a) cutting a piece of stainless steel to delineate a first flat portion, a second flat portion, a third flat portion, and a connecting portion; (b) cutting a round hole into the first flat portion; (c) cutting an elongated hole into the second flat portion to accommodate a mounting screw; (d) cutting an elongated hole into the third flat portion to accommodate a mounting screw; (e) cutting a round hole into the connecting portion to accommodate a seizure screw; (f) cutting two oval holes into the connecting portion on either side of the round hole in the connecting portion; (g) bending the third flat portion backwards until the third flat portion is substantially orthogonal to the first flat portion; (h) bending the second flat portion forwards until the second flat portion is substantially orthogonal to the first flat portion; and (i) forming four bends in the connecting portion to create a box with a top side, a bottom side opposite the top side, a front side, and a rear side opposite the front side, with a right side being formed from edges of the top side, the bottom side, the front side, and the rear side, and with a left side opposite the right side being formed from edges of the top side, the bottom side, the front side, and the rear side; wherein the top side contains the round hole accommodating the seizure screw, and the front and rear sides contain the oval holes.

DETAILED DESCRIPTION OF THE PREFERRED EMBODIMENT

Figure 1:
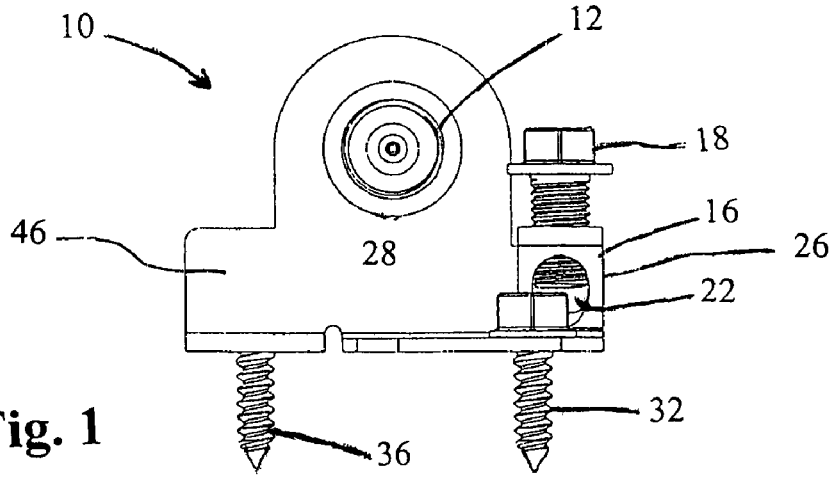
FIG. 1 shows a front elevation view of a bonding block according to an embodiment of the invention.
Figure 2:
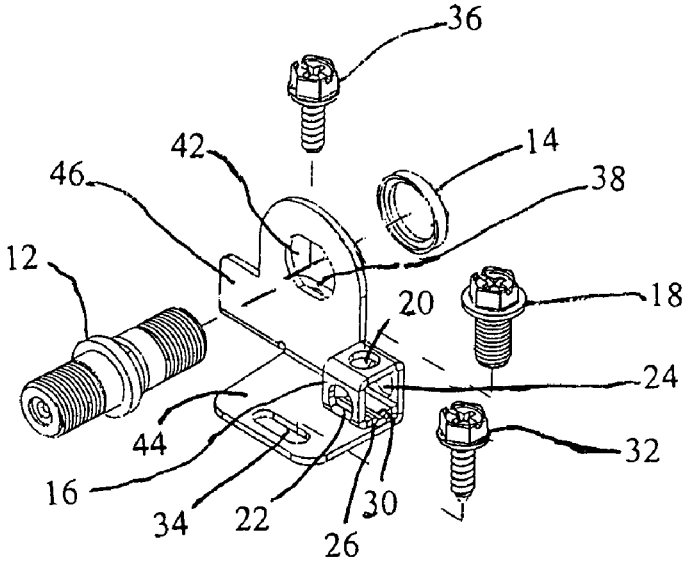
FIG. 2 shows an exploded perspective view of the bonding block of FIG. 1.
Figure 3:
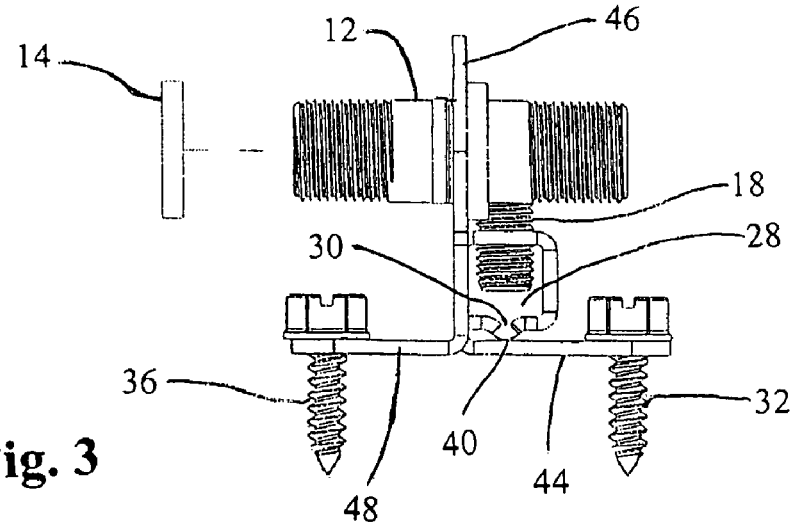
FIG. 3 shows a left side elevation view of the bonding block of FIG. 1.
Figure 4:
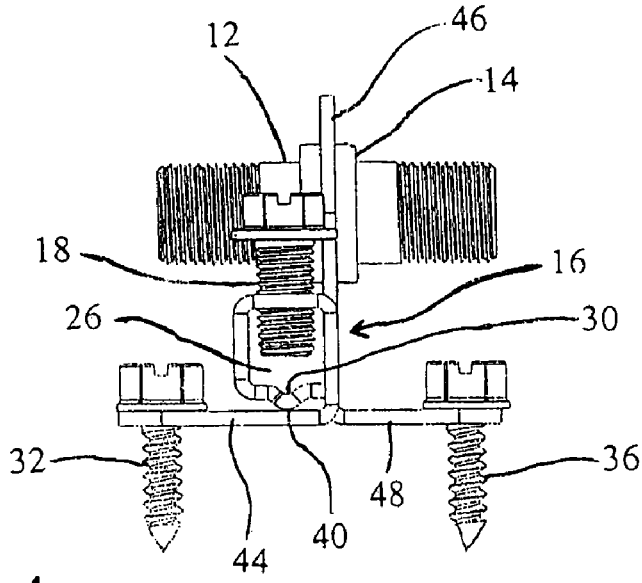
FIG. 4 shows a right side elevation view of the bonding block of FIG. 1.
Figure 5:
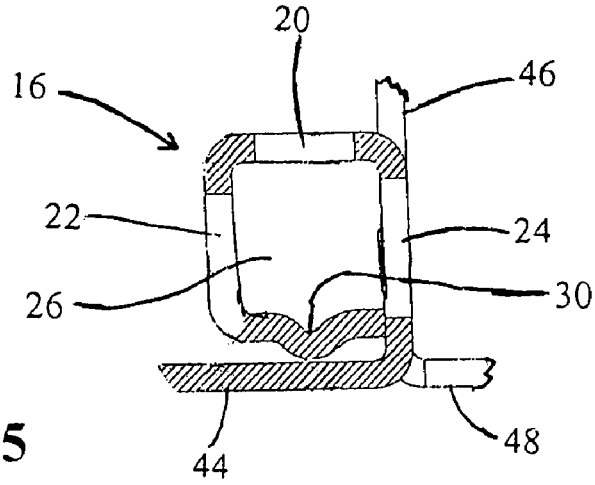
FIG. 5 shows a partial cross-sectional view of a connecting portion of the bonding block of FIG. 1.

Referring to FIGS. 1-5, a bonding block 10 includes a flat portion 46, a flat portion 44 preferably orthogonal to flat portion 46, a flat portion 48 preferably parallel to flat portion 44 and orthogonal to flat portion 46, and a connecting portion 16. Flat portions 44, 46 and connecting portion 16 are all preferably cut and folded from the same piece of stainless steel, thus providing excellent electrical conductivity between the portions.

A hole 42 within flat portion 46 is preferably dimensioned to receive a connector body 12 which is preferably of a material suitably corrosion resistant, such as brass, and press-fitted into hole 42. After connector body 12 is press-fitted into hole 42, a dress ring 14 is preferably press-fitted from a first direction onto connector body 12 from a second direction opposite the first direction, thus forming a press-fit and stake connection between connector body 12 and flat portion 46. Because connector body 12 is press-fitted to flat portion 46, it is relatively easy to weather seal the connection because of the flat areas of connector body 12 on either side of flat portion 46, i.e., because connector body 12 is not screwed into hole 42, there are no threads which need to be weather-sealed.

Connecting portion 16 is preferably a one-piece folded metal frame with a hole 20 for a seizure screw 18 which, when screwed in, holds a ground wire (not shown) in place to effect a very low-resistance corrosion-resistant ground path from the ground wire through connecting portion 16, flat portion 44, and flat portion 46 to connector body 12. Although connecting portion 16 includes a groove 30 to help seize the ground wire when the ground wire is inserted through an aperture 26 or an aperture 28, the ground wire can also be inserted into connecting portion 16 through an aperture 22 or an aperture 24. Apertures 22 and 24 are preferably made oval in shape to avoid sharp edges when creating connection portion 16 by bending the starting blank. Connecting portion 16 is preferably welded to flat portion 44 at a weld point 40 to provide additional strength to connection portion 16.

A plurality of mounting screws 32, 36 fit into holes 34, 38, respectively, in flat portions 44, 48, respectively, to mount bonding block 10 into a wall or other structure during installation.

Figure 6:
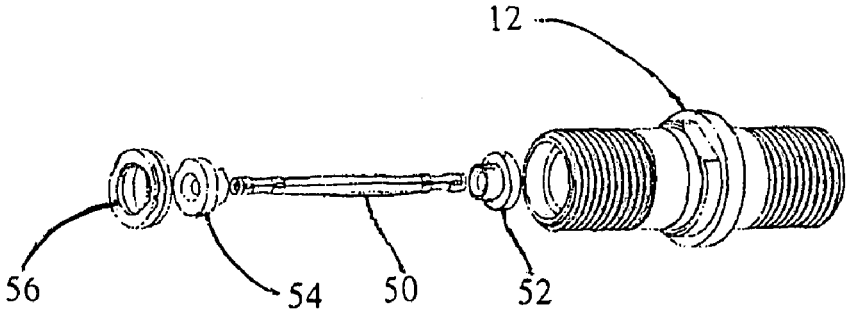
FIG. 6 shows an exploded perspective view of a connector body used in the bonding block of the invention.

Referring to FIG. 6, connector body 12 is shown in more detail. A contact 50 preferably has four "fingers" at each end to make good electrical contact with the center conductor of any coaxial cables connected to connector body 12. Insulators 52 and 54 keep contact 50 properly positioned and insulated from the outside of connector body 12. An end (not shown) of connector body 12 is formed such that only a through hole (not shown) permits the central conductor of the attached coaxial cable to be inserted. As insulator 52, contact 50, and insulator 54 are inserted into connector body 12 as shown in FIG. 6, the end of connector body 12 stops the movement of these components into connector body 12. A plug 56, preferably of nickel plated brass, fits into the shown end of connector body 12 to keep the listed components in place.

Using a single blank of stainless steel provides a location for the ground wire to attach to connecting portion 16 which in turn is electrically connected through flat portions 44 and 46 to connecting body 12, thus minimizing the number of separate, discrete contacts between the ground wire and the metal connector body. The geometry of bonding block 10 is such that a weather seal or seals can be used to effectively seal the connection between connector body 12 and flat portion 46. Forming bonding block 10 from the stainless steel blank is preferably done by progressive die stamping, although laser cutting could be used.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

The invention claimed is:

1. A bonding block, comprising:

a first flat portion;

a second flat portion orthogonal to and connected to the first flat portion;

a third flat portion orthogonal to and connected to the first flat portion, and substantially parallel to the second flat portion;

a cable connector body connected to the first flat portion;

a connecting portion connected to the second flat portion, wherein the connecting portion includes a folded metal frame;

the folded metal frame creating a box with a top side, a bottom side opposite the top side, a front side, and a rear side opposite the front side, with a right side being formed from edges of the top side, the bottom side, the front side, and the rear side, and with a left side opposite the right side being formed from edges of the top side, the bottom side, the front side, and the rear side;

a seizure screw in the top side; and a plurality of openings in the front side, the rear side, the right side, and the left side, wherein each of the plurality of openings permits a ground wire to be retained within the folded metal frame by the seizure screw.

2. A bonding block according to claim 1, further comprising mounting holes in the second flat portion and the third flat portion.

3. A bonding block according to claim 1, wherein the first flat portion, the second flat portion, the third flat portion, and the ground connecting portion are all one-piece.

4. A bonding block according to claim 3, wherein the first flat portion, the second flat portion, the third flat portion, and the ground connecting portion are all of stainless steel.

5. A bonding block according to claim 1, further comprising a groove in the bottom side.

6. A bonding block according to claim 5, further comprising a weld connecting the bottom side of the folded metal frame of the connecting portion to the second flat portion.

* * * * *